US009958814B2

(12) United States Patent
Ebihara et al.

(10) Patent No.: US 9,958,814 B2
(45) Date of Patent: May 1, 2018

(54) IMAGE FORMING APPARATUS WITH FUNCTION FOR DETERMINING RECORDING MATERIAL STIFFNESS

(71) Applicant: CANON KABUSHIKI KAISHA, Tokyo (JP)

(72) Inventors: Shun-ichi Ebihara, Suntou-gun (JP); Tomonori Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/299,870

(22) Filed: Oct. 21, 2016

(65) Prior Publication Data

US 2017/0123354 A1 May 4, 2017

(30) Foreign Application Priority Data

Oct. 29, 2015 (JP) ..... 2015-213020

(51) Int. Cl.
*G03G 15/20* (2006.01)

(52) U.S. Cl.
CPC ..... *G03G 15/2039* (2013.01); *G03G 15/2028* (2013.01); *G03G 2215/0132* (2013.01); *G03G 2215/2035* (2013.01)

(58) Field of Classification Search
CPC ..... G03G 15/2039; G03G 15/2028
USPC ..... 399/69
See application file for complete search history.

(56) References Cited

U.S. PATENT DOCUMENTS

2006/0222386 A1* 10/2006 Koshida ..... G03G 15/657 399/44
2007/0264033 A1* 11/2007 Koshida ..... G03G 15/657 399/16

FOREIGN PATENT DOCUMENTS

| | | | |
|---|---|---|---|
| JP | 8-202178 | A | 8/1996 |
| JP | 2005-170640 | A | 6/2005 |
| JP | 2006-267193 | A | 10/2006 |
| JP | 2008-110827 | A | 5/2008 |
| JP | 2011-008120 | A | 1/2011 |
| JP | 2012-088377 | A | 5/2012 |
| JP | 2012-098542 | A | 5/2012 |

* cited by examiner

*Primary Examiner* — Billy Lactaoen
(74) *Attorney, Agent, or Firm* — Fitzpatrick, Cella, Harper & Scinto

(57) ABSTRACT

An image forming apparatus includes first and second feeding units for feeding a recording material while nipping the recording material; a guiding member for guiding the recording material passed through the first feeding unit toward the second feeding unit; a measuring unit for measuring a time required for the recording material to pass from a first point to a second point provided downstream of the first point with respect to a recording material feeding direction; and a discriminating unit for discriminating stiffness of the recording material on the basis of a measurement result of the measuring unit. The guiding member is flexed and is in a non-overlapping state with a virtual line connecting a first nip where the first feeding unit nips the recording material and a second nip where the second feeding unit nips the recording material.

26 Claims, 8 Drawing Sheets

(a)

(b)

(a)

| (1)BEFORE PASSING X | (2)DURING PASSING X | (3)DURING PASSING Y |
|---|---|---|
|   |   |   |
| 45a OUTPUT : L<br>45b OUTPUT : L | 45a OUTPUT : H<br>45b OUTPUT : L | 45a OUTPUT : H<br>45b OUTPUT : H |

(b)

IMAGE FORMING APPARATUS WITH FUNCTION FOR DETERMINING RECORDING MATERIAL STIFFNESS

FIELD OF THE INVENTION AND RELATED ART

The present invention relates to an electrophotographic image forming apparatus such as a copying machine, a printer or a facsimile machine.

Conventionally, the electrophotographic image forming apparatus provides a print having an optimum image quality by controlling a toner transfer condition and a fixing condition depending on a species or type of a recording material. The species of the recording material used for printing is set through an operation panel provided on the image forming apparatus or an external computer connected with the image forming apparatus via a network. In recent years, for the purpose of improvement in usability, the image forming apparatus automatically discriminates the species of the recording material, so that the printing can be made under an optimum condition without troubling a user. As a means for discriminating the species of the recording material, the following methods are disclosed. For example, Japanese Laid-Open Patent Application (JP-A) 2012-88377 discloses a method of discriminating stiffness of the recording material on the basis of a difference in passing time due to a difference in degree of feeding slip in a curved feeding path. Further, JP-A 2006-267193 discloses a method of discriminating the stiffness of the recording material on the basis of a difference in passing time due to a difference in a similar curved feeding path. Further, JP-A Hei 8-202178 discloses a method of discriminating the stiffness of the recording material on the basis of a difference in passing time due to a difference in degree of flection by a self-weight of the recording material.

Further, consumables such as a toner supplying container mounted in the image forming apparatus or devices such as a photosensitive drum, a developing device, a fixing device and a transfer device which are short in lifetime compared with a main assembly of the image forming apparatus are assembled into a unit, and when a lifetime thereof reaches an end of an exchange lifetime thereof, the unit is exchanged with a fresh (new) unit on a unit basis. As a result, the image forming apparatus can be continuously used. However, in order to accurately notify the lifetime of the exchange part (component), there is a need to estimate a degree of deterioration of the exchange part with accuracy. For this reason, JP-A 2011-8120 discloses a method in which prediction accuracy is improved by making correction of prediction calculation of the degree of deterioration depending on a thickness or a surface roughness of the recording material used for printing.

However, as in JP-A 2012-88377 and JP-A 2006-267193, in the case where the recording material is fed in the feeding path in a largely flexed state, behavior of the feeding slip becomes unstable by the influence of deterioration of a member relating to recording material feeding in some instances. As a result, there is a liability that a variation in passing time during passing time measurement becomes large. Further, for example, as in JP-A Hei 8-202178, in the case where the passing time is measured in a state in which a guiding member is not provided in a recording material feeding path, i.e., in a state in which an attitude of the recording material is not regulated, there is a liability that a variation in measured value increases by the influence of flapping of the recording material during feeding. Accordingly, in the conventional methods, measurement of the stiffness of the recording material with accuracy cannot be made, with the result that the image forming apparatus cannot be controlled under an optimum condition depending on the species of the recording material in some cases. Further, also the correction of the prediction calculation of the degree of deterioration is insufficient only on the basis of the above-described thickness or surface roughness of the recording material, and particularly the stiffness of the recording material has a large influence on deterioration of the fixing device subjected to high temperature and high pressure when the recording material is passed through the fixing device. For that reason, from the above-described viewpoints, there is a need to make the measurement of the stiffness of the recording material with accuracy.

SUMMARY OF THE INVENTION

The present invention has been accomplished in view of the above-described circumstances. A principal object of the present invention is to provide an image forming apparatus capable of discriminating stiffness of a recording material with accuracy.

According to an aspect of the present invention, there is provided an image forming apparatus comprising: a first feeding unit and a second feeding unit each for feeding a recording material while nipping the recording material; a guiding member for guiding the recording material passed through the first feeding unit toward the second feeding unit; a measuring unit for measuring a time required for the recording material to pass from a first point to a second point provided downstream of the first point with respect to a recording material feeding direction; and a discriminating unit for discriminating stiffness of the recording material on the basis of a measurement result of the measuring unit, wherein the guiding member is flexed and is in a non-overlapping state with a virtual line connecting a first nip where the first feeding unit nips the recording material and a second nip where the second feeding unit nips the recording material.

Further features of the present invention will become apparent from the following description of exemplary embodiments with reference to the attached drawings.

DESCRIPTION OF THE EMBODIMENTS

Embodiments of the present invention will be described specifically with reference to the drawings.

Embodiment 1

In Embodiment 1, a state in which a difference in passing time of a recording material through a feeding path generates depending on stiffness of the recording material will be described, and then an embodiment in which an image forming condition is properly controlled depending on the passing time difference will be described.

[Image Forming Apparatus]

Figure 1:
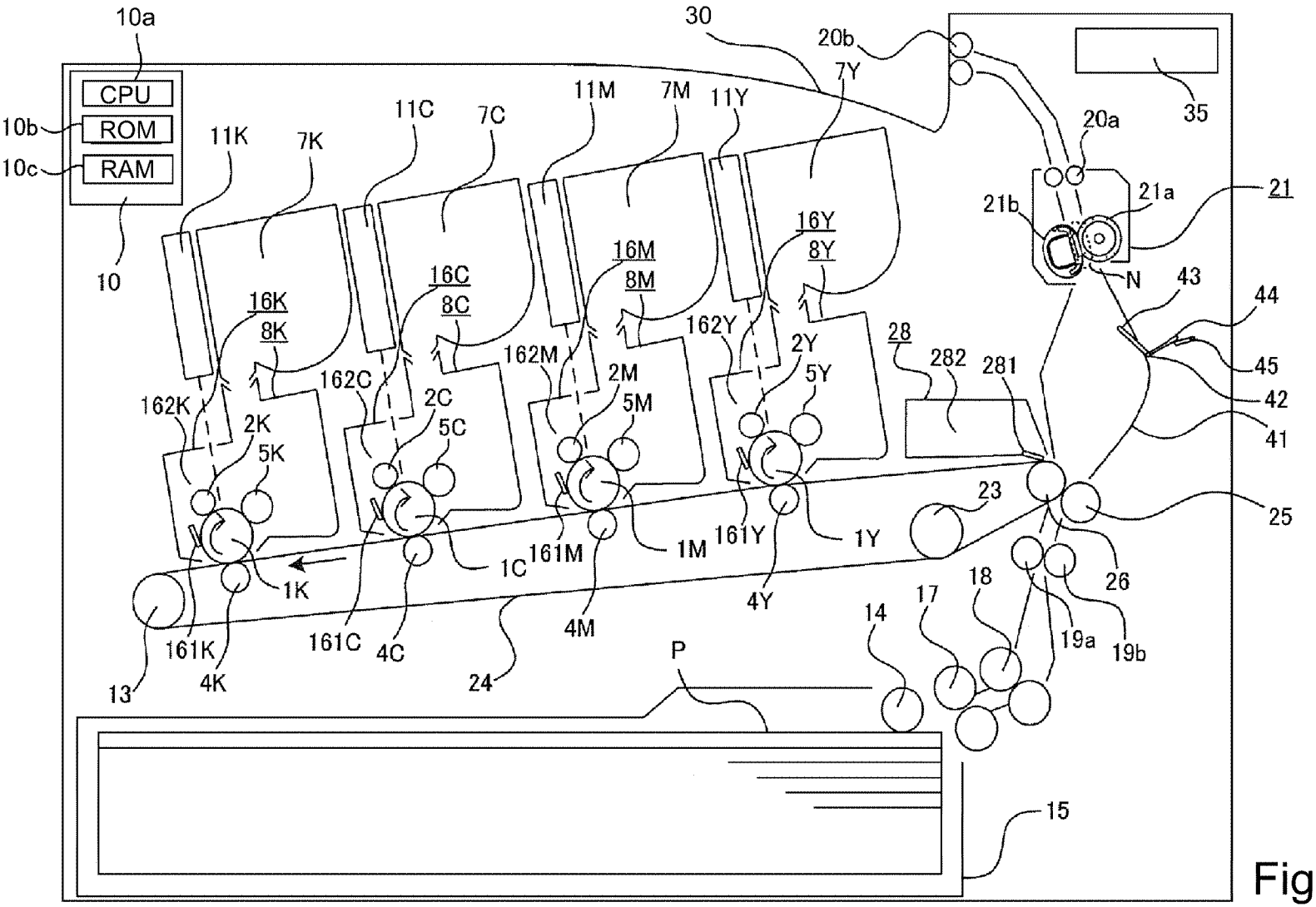
FIG. 1 is a sectional view showing a structure of an image forming apparatus in Embodiments 1 and 2.

FIG. 1 is a sectional view showing a structure of an image forming apparatus in this embodiment. In this embodiment, as an example of the image forming apparatus, a color printer including an intermediary transfer belt 24 is used. An image forming portion for effecting image formation is constituted by every color of toners and includes stations of yellow (Y), magenta (M), cyan (C) and black (K) arranged in the named order from an upstream side with respect to a rotational direction of the intermediary transfer belt 24. In the following, with reference to FIG. 1, suffixes Y, M, C and K represent the colors of toners and will be omitted from description except when necessary.

Each of the stations for forming images of the respective colors includes a photosensitive drum 1 as an image bearing member, a charging roller 2 as a charging means, an exposure scanner portion 11, a developing device as a developing means, a toner container as a toner supplying means, and a drum cleaner 16. The intermediary transfer belt 24 onto which the toner images are transferred from the photosensitive drums 1 of the respective stations is driven by a secondary transfer roller 25, a driving roller 26 functioning as an opposing roller to the secondary transfer roller 25, a stretching roller 3 and an auxiliary roller 23. Further, the image forming apparatus includes a primary transfer roller 4 to which a transfer voltage is applied when the toner image is transferred from the photosensitive drum 1 onto the intermediary transfer belt 24, a fixing portion 21 as a fixing means, and a controller 10.

The controller 10 effects system control of the image forming apparatus and includes CPU 10*a* for effecting the system control of the image forming apparatus, ROM 10*b* in which a control program is stored (written), and RAM 10*c* in which the control and image data are stored. The RAM 10*c* as a storing means is a non-volatile memory capable of maintaining a stored value even when electric power supply to the image forming apparatus is stopped. The CPU 10*a* includes a timer for measuring time and effects setting and acquisition (reading) of a timer value.

When the controller 10 receives an image signal, a recording material P is fed from a sheet feeding cassette 15 into the image forming apparatus by a pick-up roller 14 and feeding rollers 17 and 18. Then, the fed recording material P is once sandwiched (nipped) between a conveying (registration) roller 19*a* and a conveying (registration) roller 19*b* which are used for achieving synchronization between an image forming operation described later and the feeding of the recording material P, and is kept on stand-by until the recording material P is fed again.

The photosensitive drum 1 constituting the image forming portion has a structure in which an organic photoconductive layer is applied onto an outer peripheral surface of an aluminum cylinder and is driven by an unshown driving motor, so that the photosensitive drum 1 is rotated in an arrow direction (clockwise direction) shown in FIG. 1, depending on the image forming operation. The controller 10 controls the exposure scanner portion 11, so that an electrostatic latent image depending on the received image signal is formed by the exposure scanner portion 11 on the surface of the photosensitive drum 1 electrically charged to a certain potential by the charging roller 2. The developing device 8 develops and visualizes the electrostatic latent image on the photosensitive drum 1 with the toner of an associated one of colors of Y, M, C and K of the stations. The developing device 8 includes a developing roller 5 to which a developing voltage is applied when the electrostatic latent image is visualized. In this way, the electrostatic latent image formed on the surface of the photosensitive drum 1 of each of the stations is developed into a single-color toner image by the developing device 8.

The intermediary transfer belt 24 contacts the photosensitive drum 1 during color image formation and rotates, in synchronism with rotation of the photosensitive drum 1, in an arrow direction (counterclockwise direction) in FIG. 1. The single-color toner images on the photosensitive drums 1 are successively transferred onto the intermediary transfer belt 24 by a primary-transfer voltage applied to the primary transfer rollers 4, so that a multi-color toner image is formed on the intermediary transfer belt 24. A toner remaining on each of the photosensitive drums 1 without being transferred onto the intermediary transfer belt 24 is collected by a cleaning blade 161 of the drum cleaner 16 in contact with the photosensitive drum 1, and the collected toner is stored in a toner collecting container 162.

The multi-color toner image formed on the intermediary transfer belt 24 is fed to a secondary transfer nip formed by the intermediary transfer belt 24 and the secondary transfer roller 25. The recording material P kept on the stand-by in a state in which the recording material P is sandwiched between the conveying rollers 19*a* and 19*b* while achieving the synchronization with the feeding of the multi-color toner image on the intermediary transfer belt 24 is fed to the secondary transfer nip by the conveying rollers 19*a* and 19*b*. Then, the multi-color toner image on the intermediary transfer belt 24 is transferred altogether onto the recording material P by a secondary transfer voltage applied to the secondary transfer roller 25. A toner remaining on the intermediary transfer belt 24 without being transferred onto the recording material P is collected by a cleaner blade 281 of a belt cleaner 28, and the collected toner is stored as a residual (waste) toner in a cleaner container 282.

[Fixing Portion]

Figure 2:
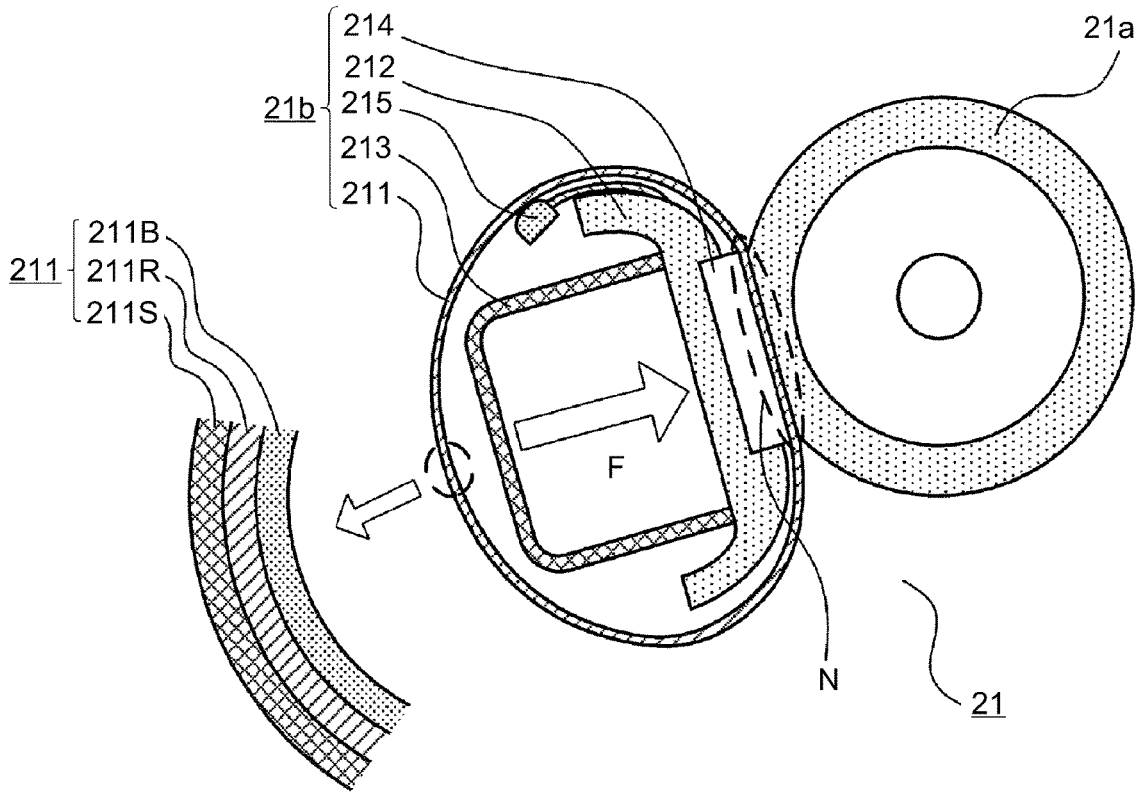
FIG. 2 is a sectional view showing a structure of a fixing portion in Embodiments 1 and 2.

The recording material P on which the multi-color toner image is transferred is fed along a feeding path to the fixing portion 21 for fixing the multi-color toner image on the recording material P by heating and pressing the multi-color toner image on the recording material P. FIG. 2 is a schematic view showing a general structure of the fixing portion 21 of the image forming apparatus in this embodiment. As shown in FIG. 2, the fixing portion 21 is constituted by a pressing roller 21*a* which has an elastic layer and which is rotatable and by a rotatable heating member 21*b* which is press-contacted to the pressing roller 21*a* and which includes a plate-shaped heat generating member 214 which is a heater portion for heating the recording material P at a fixing nip N formed between itself and the pressing roller

21*a*. A heat-resistant heating film 211 constituting the rotatable heating member 21*b* has a cylindrical shape and is loosely engaged around an outer periphery of a supporting holder 212 for holding the heating film 211 in a cylindrical shape and a metal-made fixing stay 213 for holding (supporting) the supporting holder 212. The plate-shaped heat generating member 214 is supported by the supporting holder 212 with respect to a longitudinal direction. The plate-shaped heat generating member 214 is pressed toward the pressing roller 21*a* via the heating film 211 by an unshown pressing means with a pressing force F, so that the fixing nip N is formed. The heating film 211 sandwiched between the pressing roller 21*a* and the plate-shaped heat generating member 214 is rotated around the supporting holder 212 and the fixing stay 213 by the pressing roller 21*a*. A temperature sensor 215 as a temperature detecting means contacts an inner surface of the heating film 211 and detects an inner surface temperature of the heating film 211, and then outputs a detection result to the controller 10. On the basis of the detection result of the temperature sensor 215, the controller 10 effects temperature adjustment so that the inner surface temperature of the heating film 211 is a predetermined temperature.

In a left-hand side of FIG. 2, an enlarged cross-section of the heating film 211 is shown. As shown in this enlarged cross-section, the heating film 211 in this embodiment is prepared by successively forming a 300 μm-thick elastic layer 211R and a 25 μm-thick parting layer 211S in a named order on a film 211B including a 35 μm-thick stainless material layer as a base layer. The elastic layer 211R is formed with a heat-conductive silicone rubber, and the parting layer is formed of a PFA material.

The recording material P on which the multi-color toner image is carried is not only fed by the pressing roller 21*a* but also subjected to application of heat and pressure at the fixing nip N, so that an unfixed multi-color toner image is fixed on the surface of the measurement result P. Then, the recording material P on which the toner image is fixed is discharged onto a sheet discharge tray 30 by discharging rollers 20*a* and 20*b*, so that the image forming operation is ended. A structure of the feeding path between the secondary transfer nip and the fixing nip N will be described later.

The above-described series of steps of the image forming operation is controlled by the above-described controller 10. The controller 10 is connected with a control panel 35 or an unshown host computer, where a user inputs data or information display for the user is made. The controller 10 controls the image forming apparatus depending on a command inputted through the control panel 35 or the unshown host computer. Further, the controller 10 has a function of notifying the user of states of the image forming apparatus and respective units by an alert sound and message display, a time calculating function and a calculating function of predicting and calculating a degree of deterioration of the image forming apparatus and constituent parts of the image forming apparatus as described later.

[Recording Material Feeding Path]

Figure 3:
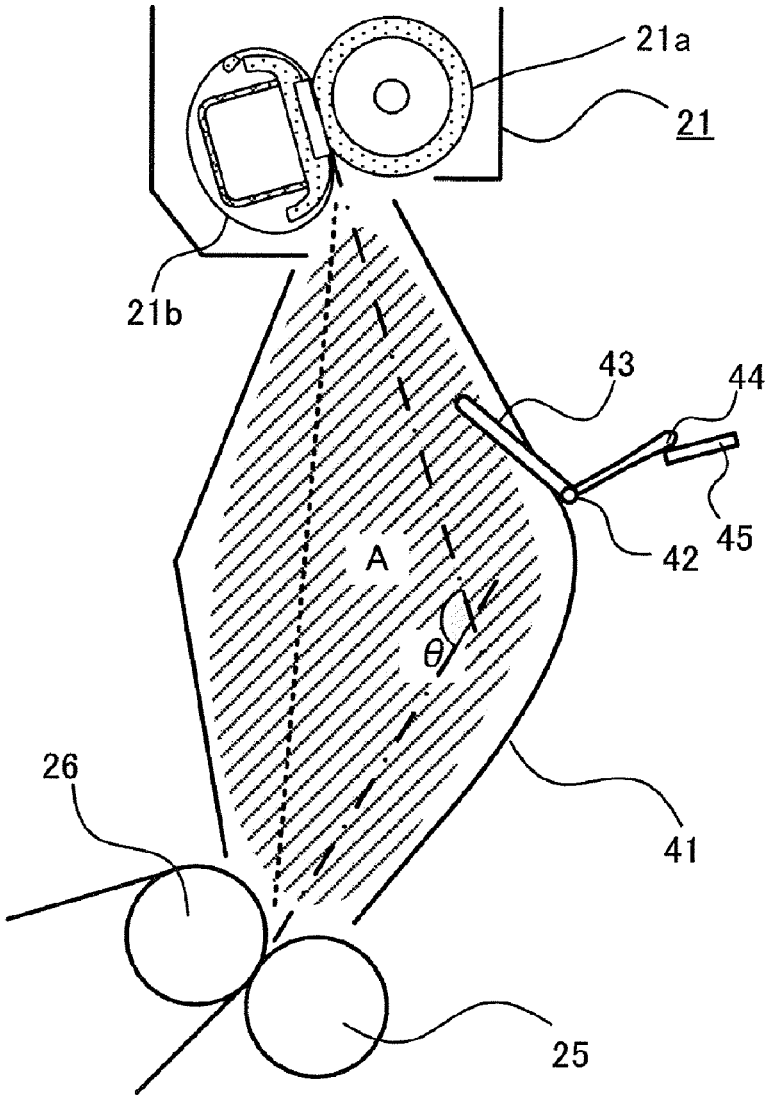
FIG. 3 is a schematic view showing a cross-section of a recording material feeding path of the image forming apparatus in Embodiments 1 and 2.

The structure of the recording material feeding path, in which a measuring portion for discriminating the stiffness of the recording material P (described later) is provided, will be described. FIG. 3 is a schematic view showing a cross-section of the feeding path of the recording material P formed between the secondary transfer nip (secondary transfer portion) which is a first feeding means (unit) and the fixing portion 21 which is a second feeding means (unit). In this embodiment, an angle θ of intersection between a discharging direction of the recording material P from the secondary transfer nip (indicated by a chain line in FIG. 3) and an entering direction of the recording material P into the fixing nip N (indicated by another chain line in FIG. 3) is 132°. The recording material P is formed so that a leading end of the recording material P passed through the secondary transfer nip is contactable to a curved feeding guiding member 41 and is feedable to the fixing nip N while having a curved shape along a wall surface of the curved feeding guiding member 41. Further, a space A is provided inside a curved portion of the feeding path, and a member contactable to the recording material P is not provided in a space between the curved feeding guiding member 41 and a rectilinear line portion (indicated by a dotted line in FIG. 3) connecting the secondary transfer nip and the fixing nip N of the fixing portion 21. The measuring is constituted by members 42-45 (described later).

Figure 4:
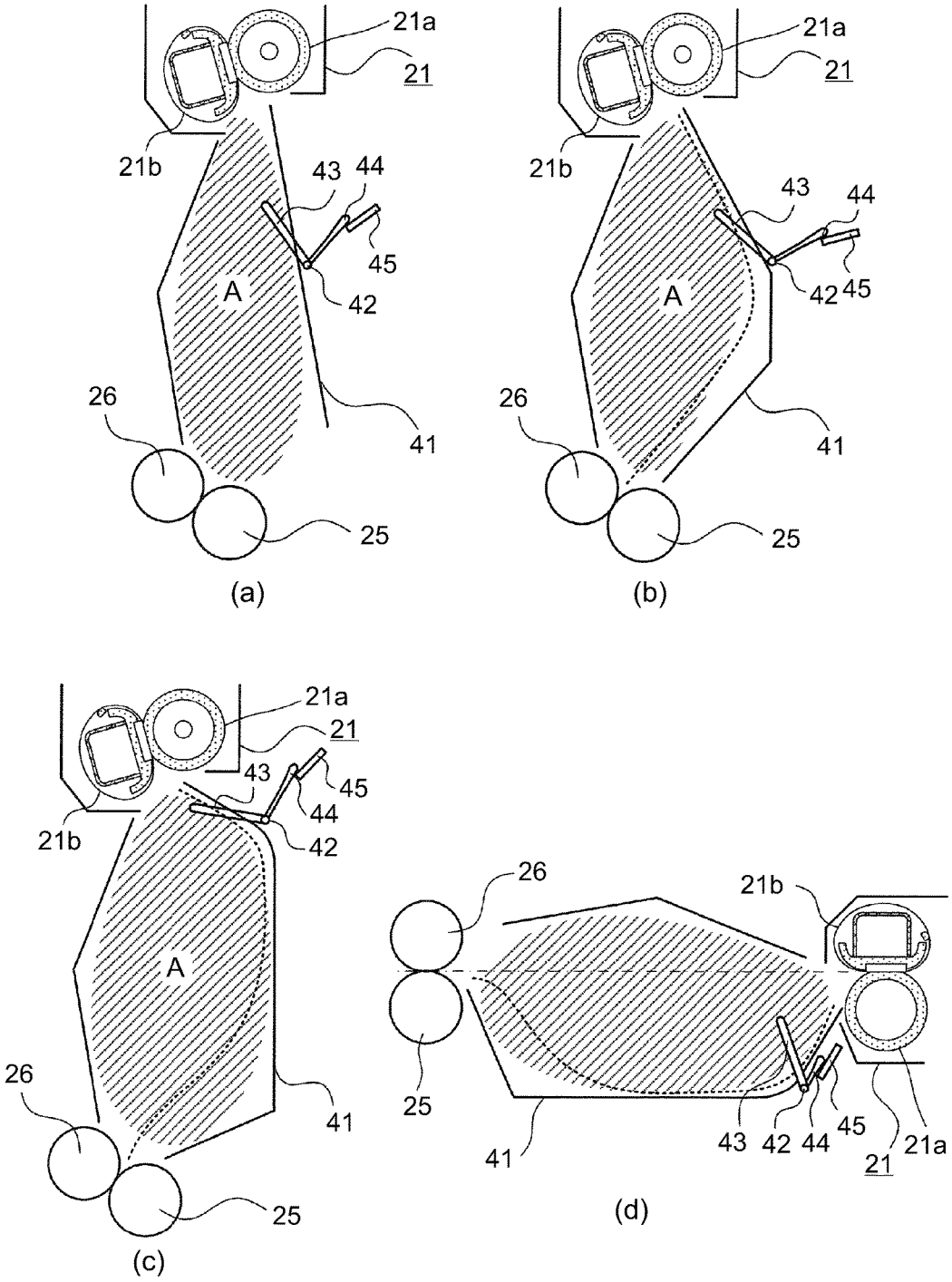
In FIG. 4, (a) to (d) are schematic views each showing a structure of a recording material feeding path of the image forming apparatus in Embodiments 1 and 2.

The curved feeding guiding member 41 constituting a wall of the feeding path guides movement of the recording material P along the feeding path in a state in which the recording material P is curved, but a cross-sectional shape of the guiding member 41 itself is not necessarily required to have the curved shape as shown in FIG. 3. In FIG. 4, (a) to (d) are schematic views each showing a cross-section of a structural example of the feeding path of the recording material P shown in FIG. 3. The cross-section of the guiding member 41 is constituted by a single rectilinear (planar) shape (line) in (a) of FIG. 4, a plurality of rectilinear (planar) lines in (b) of FIG. 4, and a combination of a plurality of rectilinear (planar) lines with a plane having a curved surface in (c) of FIG. 4. Thus, even when the cross-section of the guiding member 41 does not have the curved surface, the cross-section of the guiding member 41 is not particularly limited when the recording material P is fed and guided by the guiding member 41 while being curved. Further, as shown in (d) of FIG. 4, the present invention is also applicable even in the case where the recording material P is fed in the horizontal direction. That is, in this case, an angle of intersection (indicated by a chain line in (d) of FIG. 4) between the recording material discharging direction from the secondary transfer nip and the recording material entering direction into the fixing nip is 0°, for example. Even in such a constitution, as indicated by a dotted line in (d) of FIG. 4, the present invention is also applicable when the recording material P is fed and guided by the guiding member 41 while being curved.

[Structure of Measuring Portion]

In FIG. 3, the measuring portion for discriminating the stiffness of the recording material P is constituted by a lever 43, a flag 44 and a photo-interrupter (optical sensor) 45 as a sensor portion. The lever 43 is rotatably supported about a rotation shaft 42 as a supporting point provided outside the feeding path of the guiding member 41, and the flag 44 is provided integrally with the lever 43 at an opposite side from the lever 43 with respect to the rotation shaft 42. Further, the photo-interrupter (optical sensor) 45 includes a light-emitting portion and a light-receiving portion which are provided opposed to each other, and is constituted so as to detect a leading end position of the recording material P by detecting a light blocking state of the light from the light-emitting portion by the light-receiving portion through rotation of the flag 44. A detection result by the photo-interrupter 45 is outputted to the controller 10.

[Feeding of Recording Material Having Low Stiffness]

Figure 5:
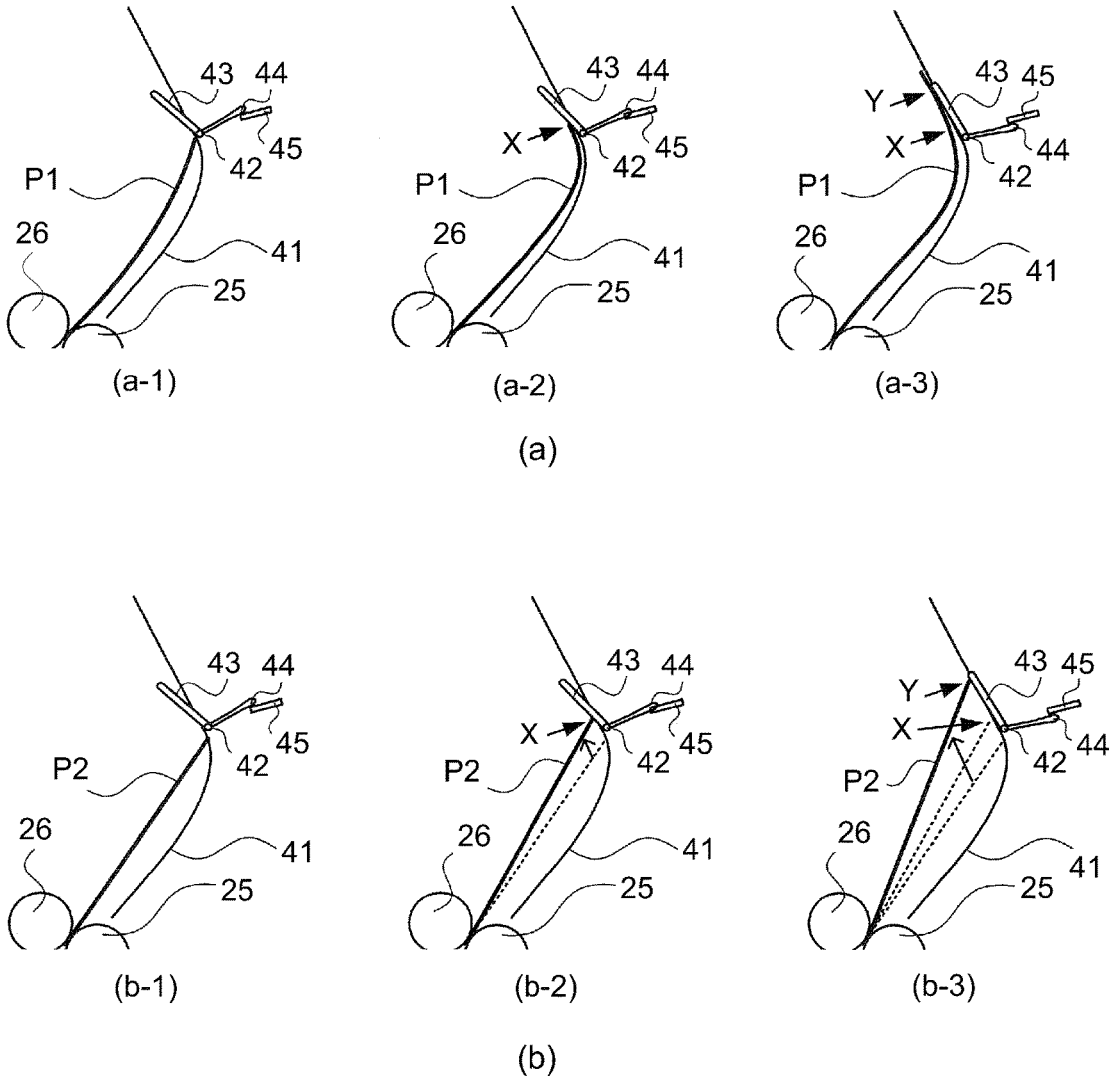
In FIG. 5, (a) and (b) are schematic views for illustrating behaviors of feeding of recording materials having a low stiffness and a high stiffness, respectively, in Embodiments 1 and 2.

In FIG. 5, (a) includes schematic views (a-1), (a-2) and (a-3) for illustrating a state of the recording material from timing when a leading end portion of a recording material P1 having relatively low stiffness passed through the secondary transfer nip to timing when the leading end portion of the recording material P is guided by the guiding member 41 and reaches the fixing portion 21 on a time-series basis. When the leading end of the recording material P1 passed through the secondary transfer nip contacts the guiding member 41 ((a-1) of (a) of FIG. 5), the recording material P1 is fed along the surface of the guiding member 41 on a non-toner surface side where the multi-color toner image is not transferred on the recording material P1, and starts rotation of the lever 43. When the leading end of the recording material P1 reaches an X portion which is a first point, the flag 44 provided in the opposite side from the lever 43 with respect to the rotational shaft 42 is rotated to a position where the light from the photo-interrupter 45 is blocked by the flag 44 ((a-2) of (a) of FIG. 5). With this rotation, a level of a signal outputted from the photo-interrupter 45 to the controller 10 is switched from a low level (L) to a high level (H). The controller 10 starts a timer at timing, as a trigger, when the output signal from the photo-interrupter 45 is switched from the low level to the high level, and thus starts measurement of a time. Then, the feeding of the recording material P1 progresses, so that the leading end of the recording material P1 reaches a Y portion which is a second point positioned downstream of the first point with respect to the recording material feeding direction. Then, the flag 44 is further rotated and moved to a position where the flag 44 permits passing (transmission) of the light from the light-emitting portion of the photo-interrupter 45 ((a-3) of (a) of FIG. 5). At this time, the level of the signal outputted from the photo-interrupter 45 is switched from the high level to the low level again. The controller 10 stops the timer at timing, as a trigger, when the output signal from the photo-interrupter 45 is switched from the high level to the low level, and thus ends the time measurement. In this way, the recording material P1 having the relatively low stiffness is fed along the guiding member 41 on the non-toner surface side, and therefore the time measured on the basis of an output signal from the measuring portion approaches a value obtained by dividing a distance between the X portion and the Y portion by the feeding speed of the recording material P1 at the secondary transfer portion.

[Feeding of Recording Material Having High Stiffness]

In FIG. 5, (b) includes schematic views (a-1), (a-2) and (a-3) for illustrating a state of the recording material from timing when a leading end portion of a recording material P2 having relatively high stiffness passed through the secondary transfer nip to timing when the leading end portion of the recording material P is guided by the guiding member 41 and reaches the fixing portion 21 on a time-series basis similarly as in (a) of FIG. 5. When the leading end of the recording material P2 passed through the secondary transfer portion contacts the guiding member 41 ((b-1) of (b) of FIG. 5), the recording material P2 is high in stiffness, and therefore is not flexed. For that reason, while only the leading end of the recording material P2 is contacted to the surface of the guiding member 41, as shown in (b-2) of (b) of FIG. 5, the recording material P2 is fed in a state in which the recording material P2 is kept in a substantially linear attitude. This attitude is also maintained at the time when the leading end of the recording material P2 reaches the X portion ((b-2) of (b) of FIG. 5) and at the time when the leading end of the recording material P2 reaches the Y portion ((b-3) of (b) of FIG. 5). Accordingly, a measured time for the recording material P2 having the relatively high stiffness approaches a value obtained by dividing a difference between a linear distance from an exit (recording material discharging opening) of the secondary transfer portion to the X portion and a linear distance from the exit of the secondary transfer portion (secondary transfer nip) to the Y portion by the recording material feeding speed at the secondary transfer portion.

In the image forming apparatus used in this embodiment, the recording material feeding speed at the secondary transfer portion is 190 mm/sec, and the distance between the X portion and the Y portion is 3.8 mm. On the other hand, the linear distance from the secondary transfer portion exit to the X portion is about 41.5 mm, and the linear distance from the secondary transfer portion exit to the Y portion is about 43.3 mm, so that a difference therebetween is about 1.8 mm. Accordingly, between the low-stiffness recording material P1 and the high-stiffness recording material P2, a difference of about 2.0 mm (=3.8 mm−1.8 mm) in distance of the feeding of the recording material P from the X portion to the Y portion generates. For that reason, the passing time of the leading end portion of the recording material P from the X portion to the Y portion is about 10 msec (=(2.0 mm/190 mm/sec)×1000 msec) longer for the low-stiffness recording material P1 than for the high-stiffness recording material P2.

[Example of Measurement Result by Measuring Portion]

Figure 6:
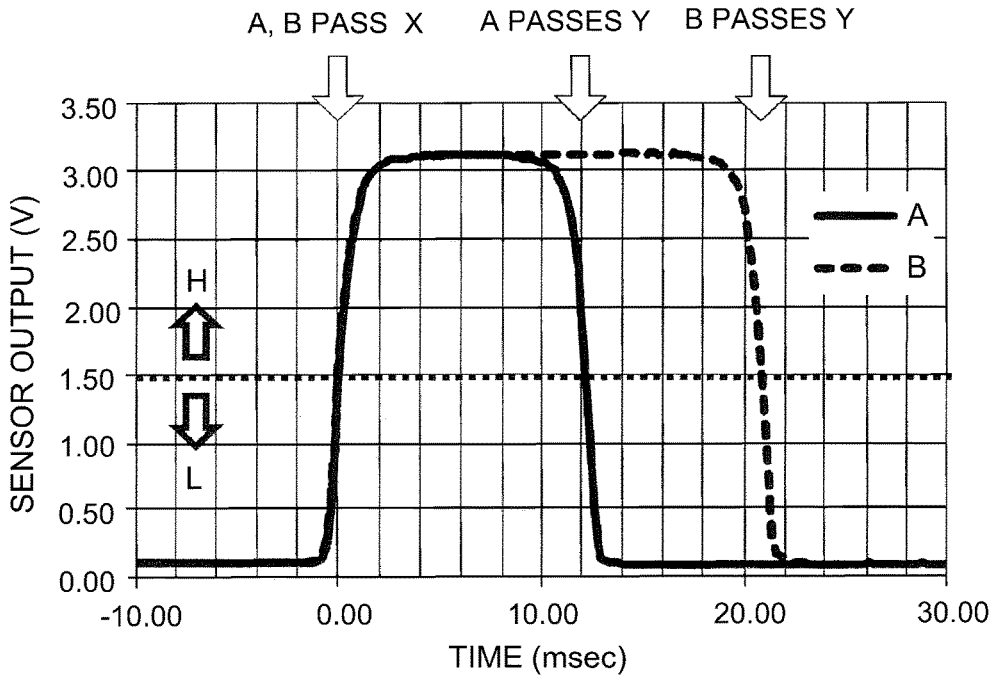
In FIG. 6, (a) is a graph showing a relationship between a time and an output data from a photo-interrupter in Embodiment 1, and (b) is a graph showing a relationship between a passing time of a recording material through two points of a feeding guide and Clark stiffness of the recording material in Embodiment 1.
Figure 6:
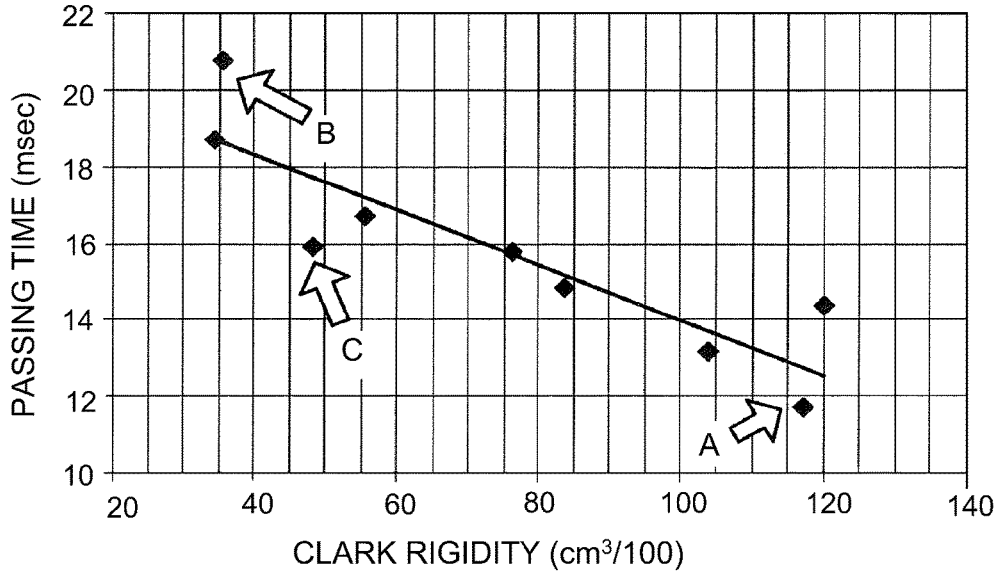

In FIG. 6, (a) is a graph of comparison of output data from the photo-interrupter 45 when two species of recording materials A and B different in stiffness are subjected to image formation in the image forming apparatus in this embodiment. In (a) of FIG. 6, the abscissa is a time (unit: msec) and the ordinate is an output (sensor output) (unit: V (volts)) of the photo-interrupter 45. Further, "H" represents a high level (H) where the sensor output is not less than 1.5 V, and "L" represents a low level (L) where the sensor output is less than 1.5 V. Further, timing when the sensor output is switched from the low level (L) to the high level (H) is the timing when the recording material passes through the X portion, and timing when the sensor output is switched from H to L is the timing when the recording material passes through the Y portion. In (a) of FIG. 6, a thick solid line represents output data of the recording material A, and a thick broken line represents output data of the recording material B.

In (a) of FIG. 6, both of the recording materials A and B pass through the X portion at a time of 0 msec. The recording material A passes through the Y portion at a time of about 12 msec, but the recording material B passes through the Y portion at a time of about 21 msec. That is, it would be considered that the high-stiffness recording material A passes from the X portion to the Y portion in about 12 msec in the above-described state shown in (b) of FIG. 5. On the other hand, it would be considered that the low-stiffness recording material B passes from the X portion to the Y portion in about 21 msec in the above-described state shown in (a) of FIG. 5. Therefore, it is understood that a difference in passing time from the X portion to the Y portion generates between the recording materials A and B.

[Relationship Between Passing Time and Clark Stiffness]

In FIG. 6, (b) is a graph showing a relationship between a measurement result of passing times measured by the above-described measuring portion for a plurality of recording materials different in stiffness and Clark stiffness (JIS P 8143) of the recording materials with respect to the recording material feeding direction. In (b) of FIG. 6, the abscissa is the Clark stiffness (unit: $cm^3/100$) and the ordinate is the passing time (unit: msec). In (b) of FIG. 6, plotted points are those each showing a correspondence between the measured passing time of the recording material and the Clark stiffness of the recording material. In (b) of FIG. 6, it is shown that a recording material having stiffness within a range between those of the recording materials A and B described above with reference to (a) of FIG. 6 has a passing time value between those of the recording materials A and B. Further, a recording material C shown in (b) of FIG. 6 is paper of 70 $g/m^2$ in basis weight substantially equal to the basis weight of the recording material B, but is different in value of the Clark stiffness from the recording material B, so that a difference in value of the Clark stiffness between the recording materials B and C appears as a difference in passing time between the recording materials B and C.

[Control of Image Forming Condition on the Basis of Stiffness of Recording Material]

As described above, depending on the stiffness of the recording material, a difference in passing time of the recording material from the X portion to the Y portion measured by the measuring portion generates. For this reason, the controller 10 discriminates the stiffness of the recording material P depending on the passing time of the recording material P, and then calculates various operation parameters of the image forming apparatus depending on a discrimination result. As a result, it becomes possible to perform an image forming operation in an optimum image forming condition. The controller 10 also functions as a discriminating means for discriminating the stiffness of the recording material P depending on the passing time of the recording material P.

In this embodiment, the controller 10 effects control of a target temperature which is a toner heating temperature at the fixing portion 21 depending on the passing time of the recording material P. For example, it would be considered that the recording material P having a short passing time from the X portion to the Y portion has high stiffness and a good separating property after being heated and pressed by the fixing portion 21. That is, a risk of winding of the recording material P about the heating film 211 is low, and therefore priority is put on a fixing property of the unfixed toner on the recording material P, and the target temperature of the surface of the heating film 211 is set at a value higher than a normal value which is a predetermined value. On the other hand, the recording material having a long passing time has low stiffness and there is a liability that the recording material winds about the heating film 211, and therefore priority is put on a parting property of the recording material, and the target temperature of the surface of the heating film 211 is set at a value lower than the normal value. Specifically, temperature adjustment for the recording material having the passing time of 10 msec from the X portion to the Y portion is made so that a detection temperature by the temperature sensor 215 is 190° C., and temperature adjustment for the recording material having the passing time of 21 msec is made so as to provide the detection temperature of 170° C. Further, for a recording material having an intermediary passing time between 10 msec and 21 msec, the target temperature is stepwisely adjusted depending on the passing time. The controller 10 functions as a temperature control means for controlling the target temperature of the surface of the heating film 211 depending on the stiffness of the recording material.

The target temperature control of the fixing portion 21 depending on the stiffness of the recording material compatibly achieves realization of a high toner fixing property and a good parting (separating) property of the recording material P which are not necessarily accomplished by conventionally known control of the target temperature depending on parameters such as the basis weight and thickness of the recording material. That is, as described above as in the case of using the recording materials B and C, in the case where the recording materials B and C have the same stiffness but have different stiffness values, in this embodiment, good parting and fixing properties can be achieved for the respective recording materials.

The recording material P is further fed after passing through the Y portion of the guiding member 41, so that the leading end of the recording material P reaches the fixing portion 21. Here, a sandwiching (nipping) force of the recording material P at the fixing portion 21 is stronger than a sandwiching force of the recording material P at the secondary transfer portion, and therefore when the feeding speed of the recording material at the fixing portion 21 and the feeding speed of the recording material at the secondary transfer portion are different from each other, the recording material P is fed in accordance with the feeding speed thereof at the fixing portion 21. For that reason, such a phenomenon that a transfer state of the toner image at the secondary transfer portion is disturbed and that the toner image is disturbed at the fixing portion 21 generates.

In the feeding path between the secondary transfer portion and the fixing portion 21, when the feeding speeds of the recording material P at the secondary transfer portion and the fixing portion 21 are different from each other, a loop amount which is a flection amount of the recording material P is different. For example, when the feeding speed of the recording material at the fixing portion 21 is higher than the feeding speed of the recording material P at the secondary transfer portion, the recording material P is pulled by the fixing portion 21, so that the recording material P is not flexed and has a linear shape. On the other hand, when the feeding speed of the recording material P at the secondary transfer portion is higher than the feeding speed of the recording material P at the fixing portion 21, the recording material P is in a flexed state in the feeding path, so that the recording material P is pressed against the guiding member 41. As a result, the recording material P contacts and pushes the lever 43, so that the flag 44 is rotated. Thus, when the loop amount of the recording material P is large, also a rotation amount of the flag 44 is large, so that the output of the photo-interrupter 45 is the low level (L). On the other hand, when the loop amount of the recording material P is small, also a rotation amount of the flag 44 is small, so that the output of the photo-interrupter changes from the low level (L) to the high level (H). Therefore, in this embodiment, on the basis of the output from the photo-interrupter 45 changing depending on the loop amount of the recording material P, the driving speed of the pressing roller 21*b* of the fixing portion 21 is switched at two levels (195 mm/sec and 185 mm/sec in this embodiment). As a result, feeding (speed) control of the recording material P can be effected so that the loop amount of the recording material P positioned between the secondary transfer portion and fixing portion 21 falls within a certain range. Further, at the fixing portion 21, as described above, the unfixed toner image is fixed on the recording material P at the target temperature determined on the basis of the stiffness of the recording material P, and then the recording material P is fed to the sheet discharge tray 30 and thus a series of steps of the image forming operation is ended.

As described above, according to this embodiment, contact of the recording material with the member constituting the feeding path is suppressed to a necessary minimum level during the measurement of the time required for the leading end of the recording material P to pass from the first point provided in the feeding path to the second point provided downstream of the first point with respect to the recording material feeding direction. For that reason, a sliding resistance associated with the feeding of the recording material P can be suppressed to a minimum level, so that it becomes possible to stably effect the passing time measurement. Further, on the basis of the measurement result of the passing time, i.e., depending on the stiffness of the recording material P, the toner heating temperature at the fixing portion 21 is controlled, so that the toner image can be fixed on the recording material P in an optimum fixing condition. As a result, it becomes possible to obtain a print having a stable image quality without causing generation of winding paper jam.

As described above, according to this embodiment, the stiffness of the recording material can be discriminated with accuracy.

Embodiment 2

In Embodiment 2, an embodiment using another constitution as the measuring means for measuring the passing time of the recording material through the feeding path and an embodiment in which a prediction calculation value of a degree of deterioration of a part (component) constituting the image forming apparatus is corrected depending on a measurement result of the passing time will be described. An image forming apparatus used in this embodiment will be described as to a difference thereof from the image forming apparatus in Embodiment 1, and the devices identical to those in Embodiment 1 are represented by the same reference numerals and will be omitted from description.

[Structure of Measuring Portion]

Figure 7:
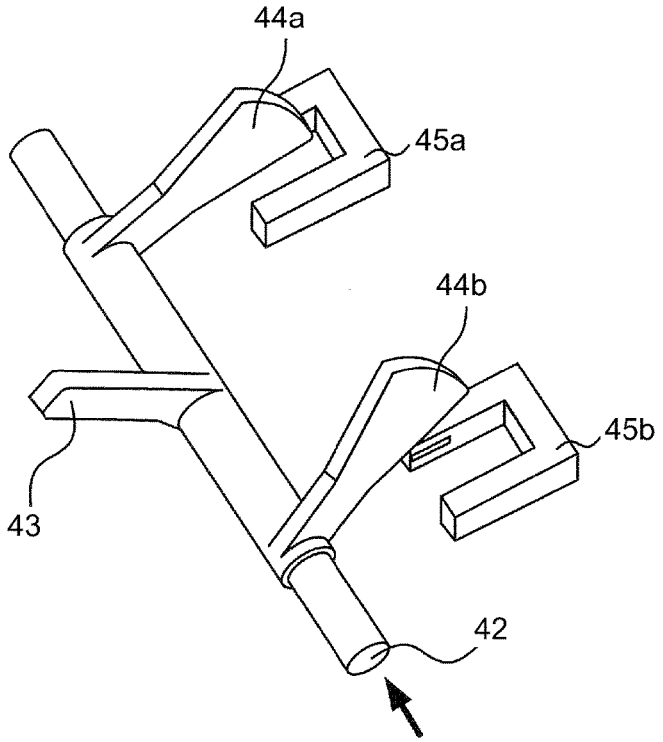
In FIG. 7, (a) and (b) are schematic views for illustrating a structure of a measuring portion in Embodiment 2.
Figure 7:
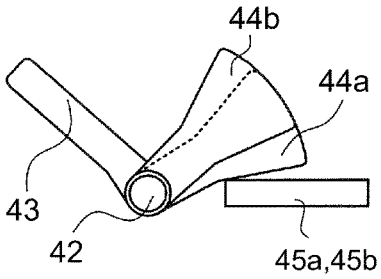
Figure 7:
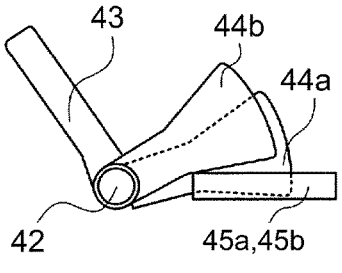
Figure 7:
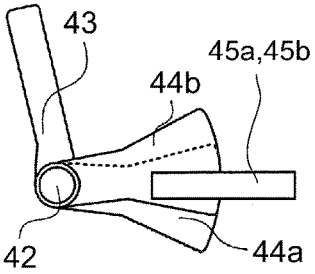

In FIG. 7, (a) is a schematic view showing a structure of a measuring portion for discriminating the stiffness of the recording material P used in this embodiment. The measuring portion in this embodiment is constituted by a lever 43, a flag 44*a* as a first flag, a flag 44*a* as a second flag, which are integrally constituted as photo-interrupter 45*a* as a first sensor portion and a photo-interrupter 45*b* as a second sensor portion. The flags 44*a* and 44*b* are provided integrally with the lever 43 at an opposite side from the lever 43 with respect to the rotation shaft 42. Each of the photo-interrupters 45*a* and 45*b* includes a light-emitting portion and a light-receiving portion which are provided opposed to each other, and is constituted so as to detect a leading end position of the recording material P by detecting a light blocking state of the light from the light-emitting portion by the light-receiving portion through rotation of the associated flag 44*a* or 44*b*. A positional relationship between the rotation shaft 42 and the leading end 43 in the feeding path is similar to that in Embodiment 1 and therefore will be omitted from illustration, but the structure of the flag 44 and the arrangement of the photo-interrupter 45 are different from those in Embodiment 1. That is, for a single leading end 43, the two flags 44 (44*a*, 44*b*) are provided at a phase (angle) different from a phase (angle) of the leading end 43 with respect to the rotation shaft 42, and corresponding to the two flags 44*a* and 44*b*, the two photo-interrupters 45*a* and 45*b* are provided, respectively. Further, the flags 44*a* and 44*b* are rotated in the same direction by rotation of the leading end 43, and the flag 44*b* is provided downstream of the flag 44*a* with respect to the rotational direction at an angle different from an angle of the flag 44*a* with respect to the rotation shaft 42. For that reason, with the rotation of the leading end 43, first, the flag 44*a* light-blocks the photo-interrupter 45*a* and then the flag 44*b* light-blocks the photo-interrupter 45*b*.

In FIG. 7, (b) is a schematic view showing a positional relationship between the two flags 44*a* and 44*b* as seen in an arrow direction shown in (a) of FIG. 7 when the leading end portion of the recording material P passes through the X portion and the Y portion and showing output signals from the associated photo-interrupters 45*a* and 45*b*. Before the recording material P passes through the X portion, both of the two flags 44*a* and 44*b* do not light-block the photo-interrupters 45*a* and 45*b*, respectively. Accordingly, the output signals from the photo-interrupters 45*a* and 45*b* are kept at the low level (L) ((1) of (a) of FIG. 7). Then, when the recording material P passes through the X portion, the flag 44*a* rotates and light-blocks the photo-interrupter 45*a*, so that the output (signal) from the photo-interrupter 45*a* is switched from the low level (L) to the high level (H) ((2) of (b) of FIG. 7). At this time, the output (signal) from the photo-interrupter 45*b* is kept at the low level (L). Then, the recording material P is further fed, so that the leading end of the recording material P reaches the Y portion. Thus, the flags 44*a* and 44*b* are further rotated and block light from the light-emitting portions of the photo-interrupters 45*a* and 45*b*, and therefore output signals from the photo-interrupters 45*a* and 45*b* are at the high level (H) ((3) of (b) of FIG. 7). The controller 10 starts a timer at timing, as a trigger, when the output signal from the photo-interrupter 45*a* is switched from the low level (L) to the high level (H), and thus starts measurement of a time. The controller 10 stops the timer at timing, as a trigger, when the output signal from the photo-interrupter 45*b* is switched from the low level (L) to the high level (H), and thus ends the time measurement.

[Example of Measurement Result by Measuring Portion]

Figure 8:
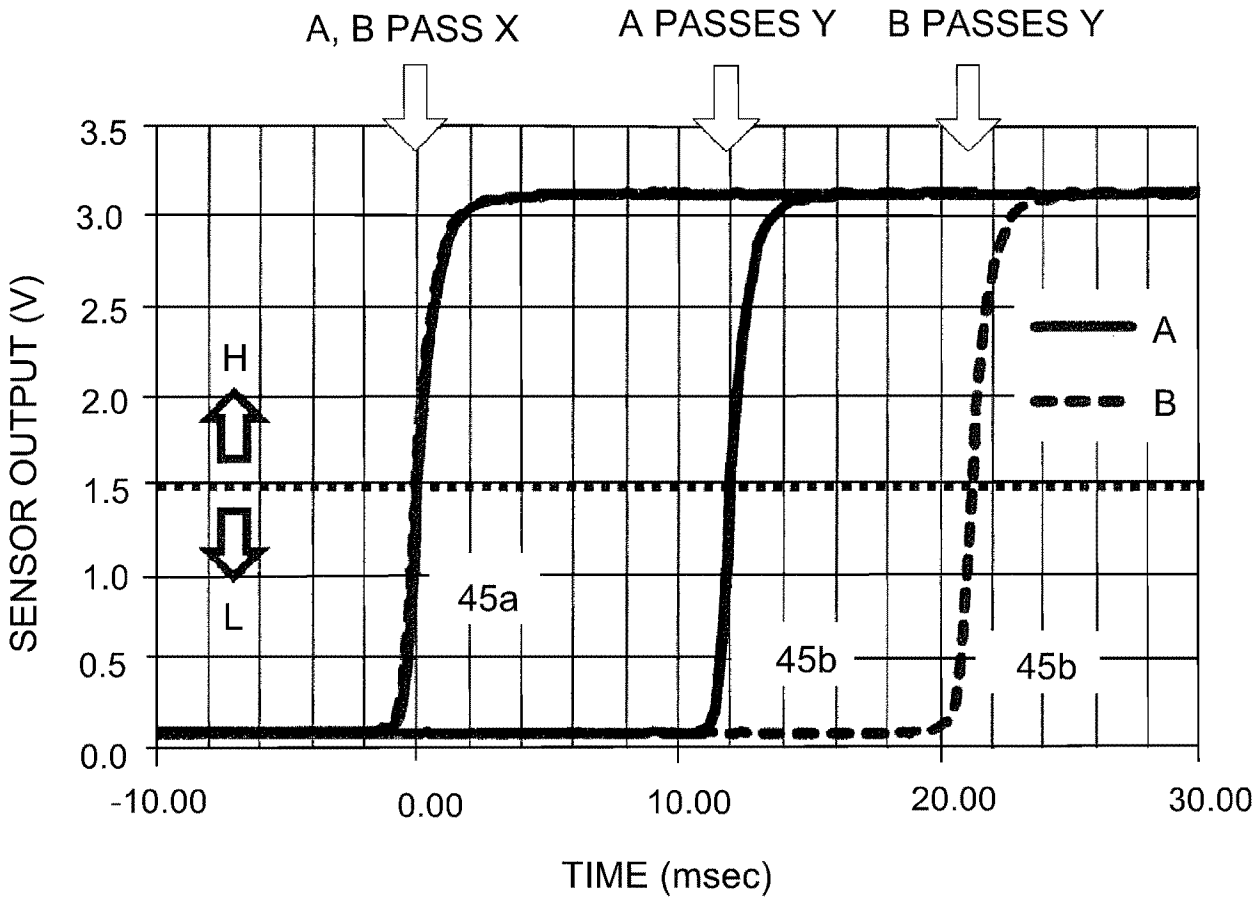
FIG. 8 is a graph showing a relationship between time and output data from a photo-interrupter in Embodiment 2.

FIG. 8 is a graph of comparison of output data from the photo-interrupters 45*a* and 45*b* when two species of recording materials A and B different in stiffness are subjected to image formation in the image forming apparatus in this embodiment. In FIG. 8, the abscissa is a time (unit: msec) and the ordinate is an output (sensor output) (unit: V (volts)) of the photo-interrupter 45. Further, "H" represents a high level (H) where the sensor output is not less than 1.5 V, and "L" represents a low level (L) where the sensor output is less than 1.5 V. Further, timing when the sensor output of the photo-interrupter 45*a* is switched from the low level (L) to the high level (H) is the timing when the recording material passes through the X portion, and timing when the sensor output of the photo-interrupter 45*b* is switched from the low level (L) to the high level (H) is the timing when the recording material passes through the Y portion. In (a) of FIG. 6, a thick solid line represents output data of the recording material A, and a thick broken line represents output data of the recording material B.

In FIG. 8, both of the recording materials A and B pass through the X portion at a time of 0 msec. The recording material A passes through the Y portion at a time of about 12 msec, but the recording material B passes through the Y portion at a time of about 21 msec. That is, the high-stiffness recording material A passes from the X portion to the Y portion in about 12 msec, and the low-stiffness recording material B passes from the X portion to the Y portion in about 21 msec. Therefore, also in this embodiment, similarly as in Embodiment 1, it is understood that a difference in passing time from the X portion to the Y portion generates between the recording materials A and B. Accordingly, similarly as in Embodiment 1, the difference in passing time measured by the measuring means generates depending on the stiffness of the recording material P, so that the controller 10 is capable of making various calculations depending on the passing time.

[Prediction of Degree of Deterioration of Fixing Portion on the Basis of Passing Time]

In this embodiment, the controller 10 corrects a prediction calculation value of the degree of deterioration of the fixing portion 21 depending on the passing time of the recording material P. The controller 10 functions as a predicting means for predicting a lifetime of the fixing portion 21 on the basis of the degree of deterioration of the fixing portion 21 corrected depending on the passing time of the recording material P, i.e., the stiffness of the recording material P. Herein, an operation time guaranteed for the image forming apparatus main assembly of the respective unit is referred to as the lifetime, and a degree of a lowering in performance of the respective units is referred to as the degree of deterioration. Specifically, as a prediction calculation value of the degree of deterioration, an abrasion amount of the parting layer 211S of the heating film 211 is calculated and then the calculated abrasion amount is corrected depending on the recording material passing time. In the image forming apparatus used in this embodiment, the normal value of the abrasion amount of the parting layer 211S due to the passing of the recording material P is $1.20\times10^{4}$ μm/page (sheet), and the controller 10 integrates the abrasion amount every feeding of one recording material P and stores an integrated abrasion amount in the RAM 10*c*. Then, the controller 10 performs lifetime calculation in which a degree that the integrated abrasion amount approaches a predetermined lifetime value of the fixing portion is represented by a percentage, and displays a calculation result on a control panel 35 and then notifies a user of the calculation result.

Herein, the passing time of the recording material P having stiffness corresponding to the normal value of the abrasion amount of the parting layer 211S due to the above-described passing of the recording material P is referred to as a predetermined time. The recording material P of which passing time is shorter than the predetermined time is high in stiffness, and therefore it can be assumed that a degree of abrasion of the parting layer 211S is large, so that the above-described abrasion amount per page (sheet) is set at a value higher than the normal value. On the other hand, the recording material P of which passing time is longer than the predetermined time is low in stiffness, and therefore it can be assumed that the degree of abrasion of the parting layer 211S is small, so that the above-described abrasion amount per page is set at a value lower than the normal value. Specifically, for the recording material P of which passing time is 12 msec, the abrasion amount per page is $1.44\times10^{-4}$ μm which is 1.2 times the normal value. On the other hand, for the recording material P of which passing time is 21 msec, the abrasion amount per page is $0.96\times10^{-4}$ μm which is 0.8 time the normal value, and for the recording material P of which passing time is an intermediary value between 12 msec and 21 msec, the abrasion amount per page is obtained by being calculated stepwisely depending on the recording material passing time. As a result, the abrasion amount of the parting layer 211S can be predicted with accuracy depending on the stiffness of the recording material P subjected to printing, so that prediction accuracy can be further improved compared with when the abrasion amount is calculated using the normal value.

As described above, according to this embodiment, the degree of deterioration of the fixing device can be predicted and calculated depending on the stiffness of the recording material with accuracy, so that it is possible to predict the degree of deterioration of the fixing device varying depending on a state of an operation by the user. Also in this embodiment, an applied range of this embodiment is not limited thereto. For example, on the basis of the passing time measurement result obtained in this embodiment, similarly as in Embodiment 1, the target temperature of the fixing device may also be controlled. Or, the result obtained in Embodiment 1 may also be applied to the prediction of the degree of deterioration of the fixing device as described in this embodiment. In addition, this embodiment is also applicable to a device in which a degree of deterioration of members thereof varies depending on the stiffness of the recording material. Further, in the above-described embodiments, the stiffness of the recording material is discriminated on the basis of the measurement result of the passing time of the recording material, and depending on the discrimination result of the stiffness, the target temperature of the fixing device is controlled or the degree of deterioration of the fixing device is predicted. For example, depending on the measurement result of the recording material passing time, not the discrimination result of the stiffness of the recording material on the basis of the measurement result of the recording material passing time, the target temperature control of the fixing device or the prediction of the degree of deterioration of the fixing device may also be effected.

As described above, according to this embodiment, the stiffness of the recording material can be directly discriminated with accuracy.

Other Embodiments

In Embodiments 1 and 2, as the members constituting the measuring portion, one lever, one or two flags, and one or two photo-interrupters are used, but the members are not limited thereto when the members can measure the recording material passing time between two points. Further, the measuring means is not limited to those in the above-described embodiments. For example, the recording material passing time may also be measured using a conventionally known measuring means such as a non-contact light detecting means. Further, the space A in the feeding path between the secondary transfer portion to the fixing portion is not limited when in the space A, a surface of the recording material opposite from a surface opposing the recording material guiding member does not contact another member. For that reason, for example, another member may also project toward a side (the curved feeding guiding member side) positioned inside the dotted line described with reference to FIG. 3.

In the image forming apparatuses used in the above-described embodiments, the recording material passing time is measured between the secondary transfer portion and the fixing portion. For example, a constitution such that a curved recording material feeding path is provided between the feeding roller portion and the registration roller portion or between the registration roller portion and the secondary transfer portion and the passing time is measured may also be employed. Further, as described above, when the recording material passing through the feeding path can be guided in a curved shape, the curved feeding guiding member itself is not necessarily required to have a curved shape.

The image forming apparatus to which the present invention is applied is not limited to a color printer including the intermediary transfer belt described in the above-described embodiments. The present invention is also applicable to image forming apparatuses such as a color printer including a feeding belt, a color printer of a rotary (developing device rotation) type, a monochromatic printer and so on.

Further, also the fixing portion is not limited to the on-demand fixing device constituted by the heating film, the heater and the pressing roller used in the above-described embodiments. It is possible to use conventionally known fixing devices, such as a heating roller-type fixing device using, e.g., a halogen heater, a fixing device of an induction heating type, and a fixing device of a surface heating type in which a fixing member is directly heated from a toner contact surface side, without being restricted particularly in terms of the heating type thereof.

As described above, also in other embodiments, the stiffness of the recording material can be discriminated with accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213020 filed on Oct. 29, 2015, which is hereby incorporated by reference herein in its entirety.

What is claimed is:

1. An image forming apparatus comprising:

a first feeding unit and a second feeding unit each for feeding a recording material while nipping the recording material, wherein the first feeding unit includes a first rotating member, and the second feeding unit includes a second rotating member;

a guiding member for guiding the recording material passed through the first feeding unit toward the second feeding unit;

a measuring unit for measuring a time required for the recording material to pass from a first point to a second point provided downstream of the first point with respect to a recording material feeding direction; and a discriminating unit for discriminating stiffness of the recording material on the basis of a measurement result of the measuring unit, wherein the discriminating unit discriminates that the stiffness of the recording material is higher than a predetermined value when the measured time is shorter than a predetermined time and discriminates that the stiffness of the recording material is lower than the predetermined value when the measured time is longer than the predetermined time, and wherein the guiding member is flexed and is in a non-overlapping state with a virtual straight line connecting a first nip where the first feeding unit nips the recording material and a second nip where the second feeding unit nips the recording material when viewed from a rotational axis direction of the first rotating member or the second rotating member.

2. The image forming apparatus according to claim 1, wherein the second feeding unit is a fixing portion including a heater portion, a film heated by the heater portion and the second rotating member as a pressing roller for forming the second nip in contact with the film and for feeding the recording material while pressing the fed recording material toward the second nip, and includes a temperature control unit for controlling a temperature of the film depending on the stiffness of the recording material discriminated by the discriminating unit.

3. The image forming apparatus according to claim 2, wherein the temperature control unit sets the temperature of the film at a value higher than a predetermined temperature when the stiffness of the recording material is higher than a first predetermined value and sets the temperature of the film at a value lower than the predetermined temperature when the stiffness of the recording material is lower than the first predetermined value.

4. The image forming apparatus according to claim 3, further comprising a predicting unit for predicting a lifetime of the fixing portion on the basis of an abrasion amount of the film, and wherein the predicting unit sets the abrasion amount of the film at a value greater than a predetermined abrasion amount when the stiffness of the recording material discriminated by the discriminating unit is higher than a second predetermined value and sets the abrasion amount of the film at a value less than the predetermined abrasion amount when the stiffness of the recording material discriminated by the discriminating unit is lower than the second predetermined value.

5. The image forming apparatus according to claim 1, wherein the first feeding unit is a transfer portion to transfer a toner image onto the recording material and the second feeding unit is a fixing portion to fix the toner image onto the recording material.

6. The image forming apparatus according to claim 1, wherein the measuring unit includes a sensor portion including a light-emitting portion and a light-receiving portion for receiving light from the light-emitting portion, a lever rotatable by contact with a leading end of the recording material, and a flag rotatable by rotation of the lever to transmit or block the light from the light-emitting portion.

7. The image forming apparatus according to claim 6, wherein the flag blocks the light from the light-emitting portion of the sensor portion when the leading end of the recording material contacting the lever reaches the first point and transmits the light from the light-emitting portion of the sensor portion when the leading end of the recording material reaches the second point.

8. The image forming apparatus according to claim 7, wherein the measuring unit measures a time from timing when the light from the light-emitting portion of the sensor portion is blocked to timing when the light from the light-emitting portion of the sensor portion is transmitted and is received by the light-receiving portion.

9. The image forming apparatus according to claim 8, wherein a feeding speed of the recording material is switched depending on a detection result of the light at the light-receiving portion of the sensor portion.

10. The image forming apparatus according to claim 1, wherein the measuring unit includes first and second sensor portions each including a light-emitting portion and a light-receiving portion for receiving light from the light-emitting portion, a lever rotatable by contact with a leading end of the recording material, and first and second flags each rotatable by rotation of the lever to transmit or block the light from an associated light-emitting portion, and wherein the second flag rotates in the same direction as the first flag and is provided downstream of the first flag with respect to a rotational direction of the first flag.

11. The image forming apparatus according to claim 10, wherein the first flag blocks the light from the associated light-emitting portion of the sensor portion when the leading end of the recording material contacting the lever reaches the first point, and the second flag blocks the light from the associated light-emitting portion of the sensor portion when the leading end of the recording material reaches the second point.

12. The image forming apparatus according to claim 11, wherein the measuring unit measures a time from timing when the light from the light-emitting portion of the sensor portion corresponding to the first flag is blocked to timing when the light from the light-emitting portion of the sensor portion corresponding to the second flag is blocked.

13. The image forming apparatus according to claim 12, wherein a feeding speed of the recording material is switched depending on a detection result of the light at the light-receiving portions of the sensor portions corresponding to the first flag and the second flag.

14. The image forming apparatus according to claim 1, wherein the first point and the second point are provided between the first feeding unit and the second feeding unit.

15. An image forming apparatus comprising:

a first feeding unit and a second feeding unit each for feeding a recording material while nipping the recording material, wherein the first feeding unit includes a first rotating member, and the second feeding unit includes a second rotating member;

a guiding member for guiding the recording material passed through the first feeding unit toward the second feeding unit;

a measuring unit for measuring a time required for the recording material to pass from a first point to a second point provided downstream of the first point with respect to a recording material feeding direction; and a controlling unit for setting a temperature to fix an image on the recording material on the basis of a measurement result of the measuring unit, wherein the controlling unit sets the temperature at a value higher than a predetermined temperature when the measured time is shorter than a predetermined time and sets the temperature at a value lower than the predetermined temperature when the measured time is longer than the predetermined time, and wherein the guiding member is flexed and is in a non-overlapping state with a virtual straight line connecting a first nip where the first feeding unit nips the recording material and a second nip where the second feeding unit nips the recording material when viewed from a rotational axis direction of the first rotating member or the second rotating member.

16. The image forming apparatus according to claim 15, wherein the first feeding unit is a transfer portion to transfer a toner image onto the recording material and the second feeding unit is a fixing portion to fix the toner image onto the recording material.

17. The image forming apparatus according to claim 16, wherein the fixing portion includes a heater portion, a film heated by the heater portion and the second rotating member as a pressing roller for forming a nip in contact with the film and for feeding the recording material while pressing the fed recording material toward the nip, and the controlling unit controls the temperature of the film on the basis of the measurement result of the measuring unit.

18. The image forming apparatus according to claim 15, wherein the measuring unit includes a sensor portion including a light-emitting portion and a light-receiving portion for receiving light from the light-emitting portion, a lever rotatable by contact with a leading end of the recording material, and a flag rotatable by rotation of the lever to transmit or block the light from the light-emitting portion.

19. The image forming apparatus according to claim 18, wherein the flag blocks the light from the light-emitting portion of the sensor portion when the leading end of the recording material contacting the lever reaches the first point and transmits the light from the light-emitting portion of the sensor portion when the leading end of the recording material reaches the second point.

20. The image forming apparatus according to claim 19, wherein the measuring unit measures a time from timing when the light from the light-emitting portion of the sensor portion is blocked to timing when the light from the light-emitting portion of the sensor portion is transmitted and is received by the light-receiving portion.

21. The image forming apparatus according to claim 20, wherein a feeding speed of the recording material is switched depending on a detection result of the light at the light-receiving portion of the sensor portion.

22. The image forming apparatus according to claim 15, wherein the measuring unit includes first and second sensor portions each including a light-emitting portion and a light-receiving portion for receiving light from the light-emitting portion, a lever rotatable by contact with a leading end of the recording material, and first and second flags each rotatable by rotation of the lever to transmit or block the light from an associated light-emitting portion, and wherein the second flag rotates in the same direction as the first flag and is provided downstream of the first flag with respect to a rotational direction of the first flag.

23. The image forming apparatus according to claim 22, wherein the first flag blocks the light from the associated light-emitting portion of the sensor portion when the leading end of the recording material contacting the lever reaches the first point, and the second flag blocks the light from the associated light-emitting portion of the sensor portion when the leading end of the recording material reaches the second point.

24. The image forming apparatus according to claim 23, wherein the measuring unit measures a time from timing when the light from the light-emitting portion of the sensor portion corresponding to the first flag is blocked to timing when the light from the light-emitting portion of the sensor portion corresponding to the second flag is blocked.

25. The image forming apparatus according to claim 24, wherein a feeding speed of the recording material is switched depending on a detection result of the light at the light-receiving portions of the sensor portions corresponding to the first flag and the second flag.

26. The image forming apparatus according to claim 15, wherein the first point and the second point are provided between the first feeding unit and the second feeding unit.

* * * * *